US007476146B2

(12) United States Patent
Bagby

(10) Patent No.: US 7,476,146 B2
(45) Date of Patent: Jan. 13, 2009

(54) UNIVERSAL FIXTURE FOR BELT SANDER

(76) Inventor: Mark Bagby, P.O. Box 143, Cornucopia, WI (US) 54827

( * ) Notice: Subject to any disclaimer, the term of this patent is extended or adjusted under 35 U.S.C. 154(b) by 0 days.

(21) Appl. No.: 11/803,089

(22) Filed: May 11, 2007

(65) Prior Publication Data

US 2008/0277554 A1 Nov. 13, 2008

(51) Int. Cl.
*B24B 41/00* (2006.01)

(52) U.S. Cl. ..... 451/361; 144/286.1; 144/287; 269/71; 269/290

(58) Field of Classification Search ..... 451/361, 451/340, 358, 355, 411; 144/286.1, 286.5, 144/287; 269/55, 71, 289 R, 290, 909
See application file for complete search history.

(56) References Cited

U.S. PATENT DOCUMENTS

| | | | | |
|---|---|---|---|---|
| 884,249 | A * | 4/1908 | Wieber | 451/361 |
| 3,016,659 | A * | 1/1962 | Reynold et al. | 451/340 |
| 3,664,614 | A | 5/1972 | Baechle | |
| 4,034,522 | A | 7/1977 | Miller | |
| 4,085,552 | A * | 4/1978 | Horine et al. | 451/340 |
| 4,114,665 | A | 9/1978 | Decker | |
| 4,349,301 | A * | 9/1982 | Boyajian | 408/112 |
| 4,483,573 | A | 11/1984 | Keller | |
| 5,083,403 | A * | 1/1992 | Otterbein, II | 451/402 |
| 5,746,193 | A * | 5/1998 | Swan | 125/13.03 |
| 5,875,698 | A * | 3/1999 | Ceroll et al. | 83/473 |
| 5,884,681 | A * | 3/1999 | Nickles | 144/329 |
| 6,374,878 | B1 * | 4/2002 | Mastley et al. | 144/48.6 |
| 6,471,568 | B1 * | 10/2002 | Wang | 451/168 |
| 6,854,701 | B2 | 2/2005 | Brockmann | |
| 6,932,073 | B2 * | 8/2005 | Zhang | 125/13.01 |
| 7,089,980 | B2 | 8/2006 | Rulli | |
| 2003/0034088 | A1 * | 2/2003 | Manning | 144/286.1 |
| 2003/0051769 | A1 * | 3/2003 | Welsh et al. | 144/287 |

* cited by examiner

*Primary Examiner*—Eileen P. Morgan
(74) *Attorney, Agent, or Firm*—McDermott Will & Emery LLP

(57) ABSTRACT

A universal fixture is provided for securing a portable power tool, such as a belt sander. The fixture has a housing with a plurality of sidewalls, and a plurality of retainers extending from the sidewalls for securing the power tool, wherein the sidewalls and retainers are adjustable to accommodate power tools of differing shapes and sizes. Further, the universal fixture is adjustable to mount the power tool in differing positions for optimal use.

19 Claims, 3 Drawing Sheets

UNIVERSAL FIXTURE FOR BELT SANDER

CROSS-REFERENCE TO RELATED APPLICATIONS

Not Applicable.

FEDERALLY SPONSORED RESEARCH OR DEVELOPMENT

Not Applicable.

TECHNICAL FIELD

The present invention relates generally to a fixture for a hand tool, and more specifically to a universal fixture for supporting a variety of belt sanders.

BACKGROUND OF THE INVENTION

Fixtures for supporting hand tools are well known in the art. While such fixtures according to the prior art individually provide a number of advantageous features, they nevertheless have certain limitations. The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

The present invention generally provides a universal fixture for a portable power tool, such as a belt sander. According to one embodiment, the universal fixture generally comprises a housing containing four sidewalls, a first adjustable retainer connected to one of the sidewalls and adapted to secure a handle of the power tool, and a second adjustable retainer connected to one of the sidewalls and adapted to secure a second handle of the power tool. The first and second adjustable retainers may both be moveable in a direction with respect to the sidewall connected thereto. Moreover, the sidewalls of the housing define a cavity in which at least a portion of the power tool is accepted. The first and second sidewalls may be adjustable in length to accept power tools of differing sizes.

According to another embodiment, the second adjustable retainer is moveable in a second direction with respect to the sidewall connected thereto.

According to another embodiment, the fixture further comprises mounting members for fixedly attaching the universal fixture to a mounting surface.

According to another embodiment, the universal fixture comprises a housing having a plurality of sidewalls defining a cavity for accepting at least a portion of a portable power tool, wherein at least two of the sidewalls are adjustable in length. The universal fixture further comprises a plurality of retainers extending from the sidewalls for securing the power tool, where at least one of the retainers is adjustable to secure power tools of varying sizes.

According to another embodiment, the universal fixture comprises a housing having a plurality of sidewalls, a first retainer, and a second retainer. The first retainer extends from one of the sidewalls and has an open cavity for securing the power tool at least partially therein. The first retainer is adjustable in a plane generally parallel to one of the sidewalls. The second retainer is angularly adjustable to a plane of one of the sidewalls, and also has an open cavity for securing the power tool at least partially therein.

According to another embodiment, at least one of the retainer cavities is adjustable to decrease in size for securing a handle of the portable power tool.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
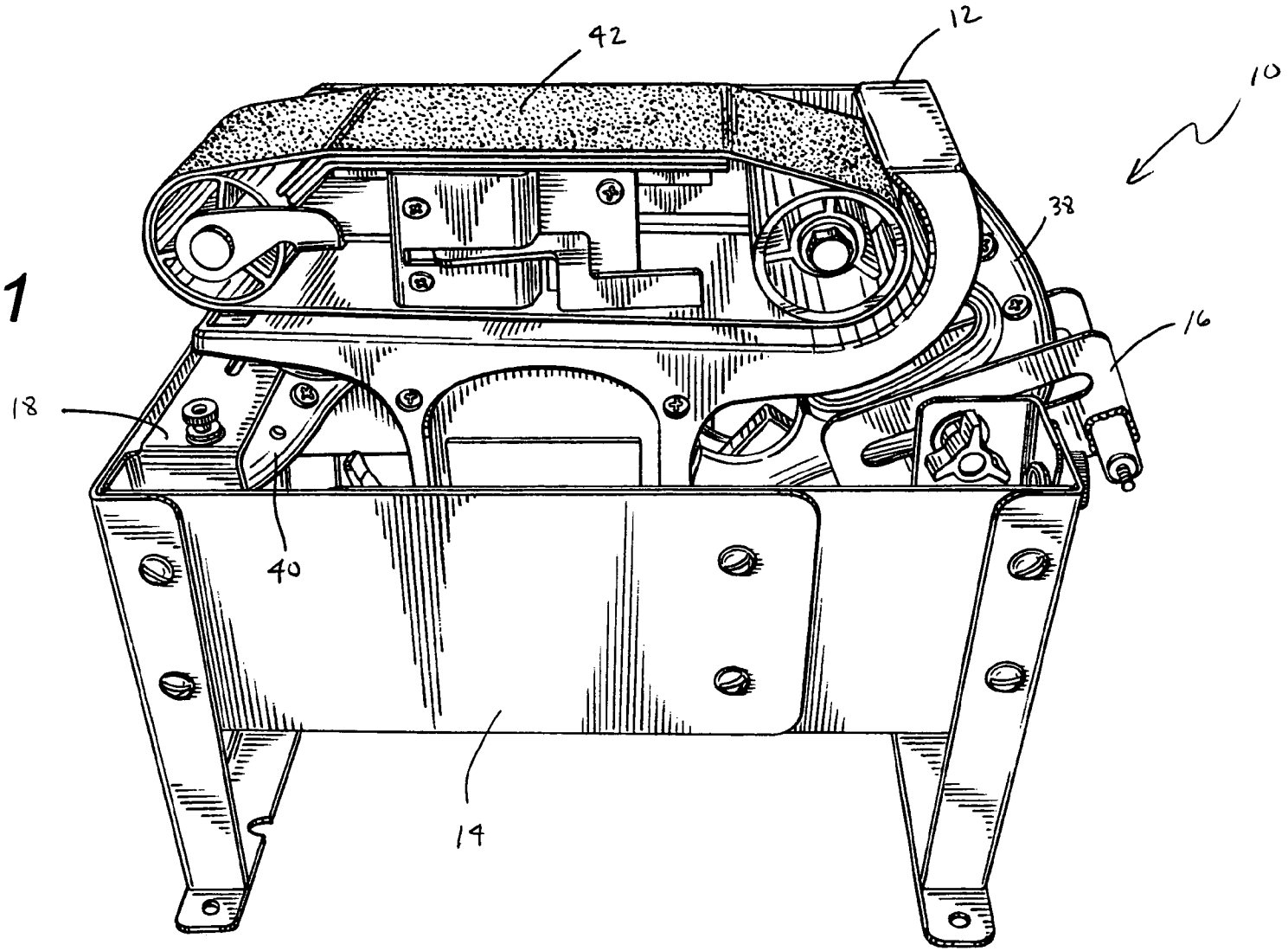
FIG. 1 is a perspective view of one embodiment of a universal fixture for retaining a power tool, with a belt sander secured therein.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to only the embodiments illustrated.

Referring now to the Figures, and specifically to FIG. 1, there is shown a universal fixture 10 to secure a portable power tool 12. In one embodiment, the universal fixture 10 is generally comprised of a housing 14, a first adjustable retainer 16, and a second adjustable retainer 18. The retainers 16, 18 extend from the sidewalls of the housing 14 and are adjustable to secure power tools 12 of varying sizes.

Figure 2:
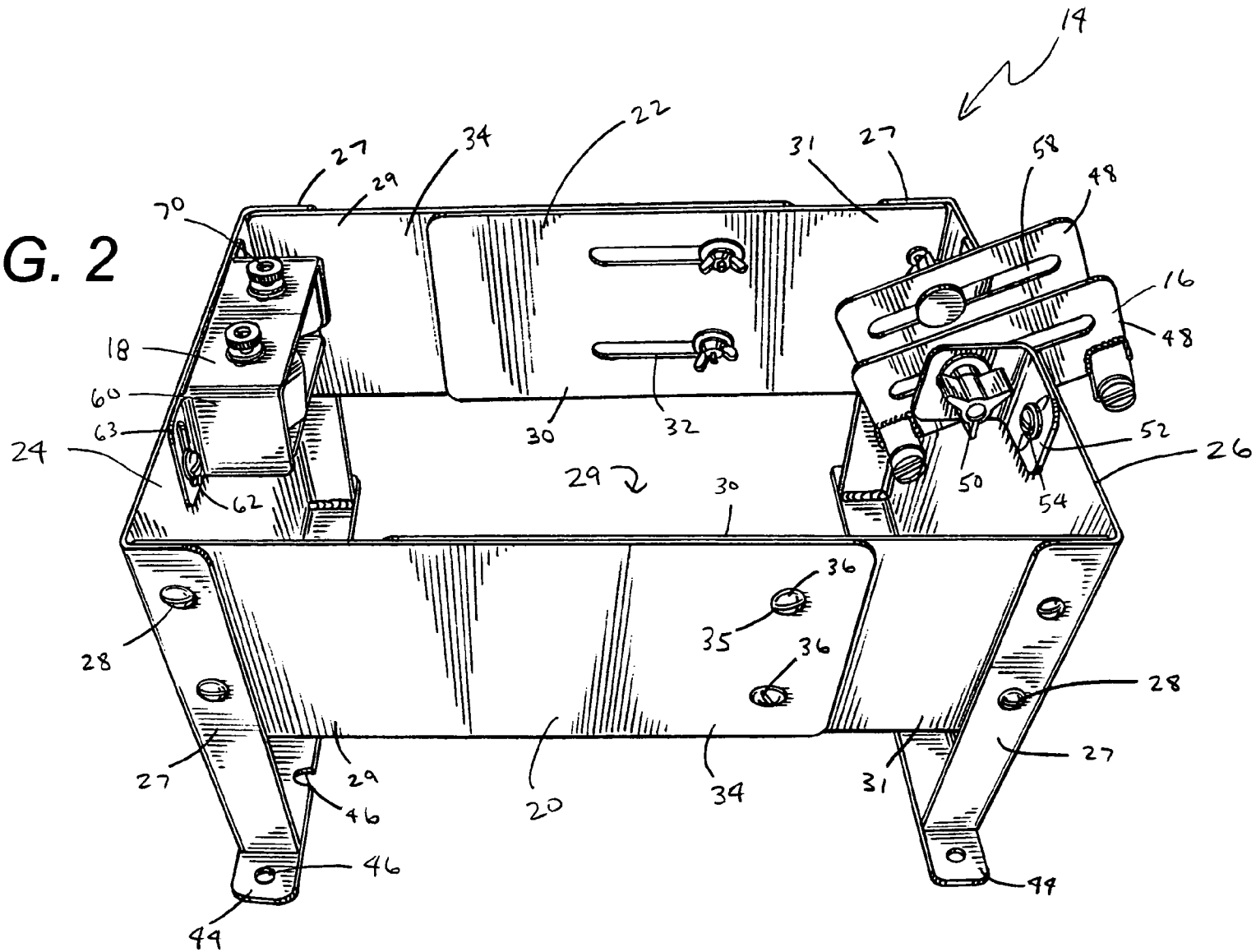
FIG. 2 is a front perspective view of the universal fixture of FIG. 1, with the belt sander removed.

As most clearly shown in FIG. 2, housing 14 is formed by a first sidewall 20, a second sidewall 22 opposing the first sidewall 20, a third sidewall 24 adjacent the first sidewall 20 and the second sidewall 22, and a fourth sidewall 26 opposing the third sidewall 24 and being adjacent the first sidewall 20 and the second sidewall 22. As shown in FIGS. 1 through 4, the area between the sidewalls 20, 22, 24, 26 defines a cavity 29 in the universal fixture 10 to accept at least a portion of a portable power tool 12. The sidewalls are preferably constructed from a lightweight, sturdy material, such as metal, however, other materials, such as plastics, may be used.

Figure 4:
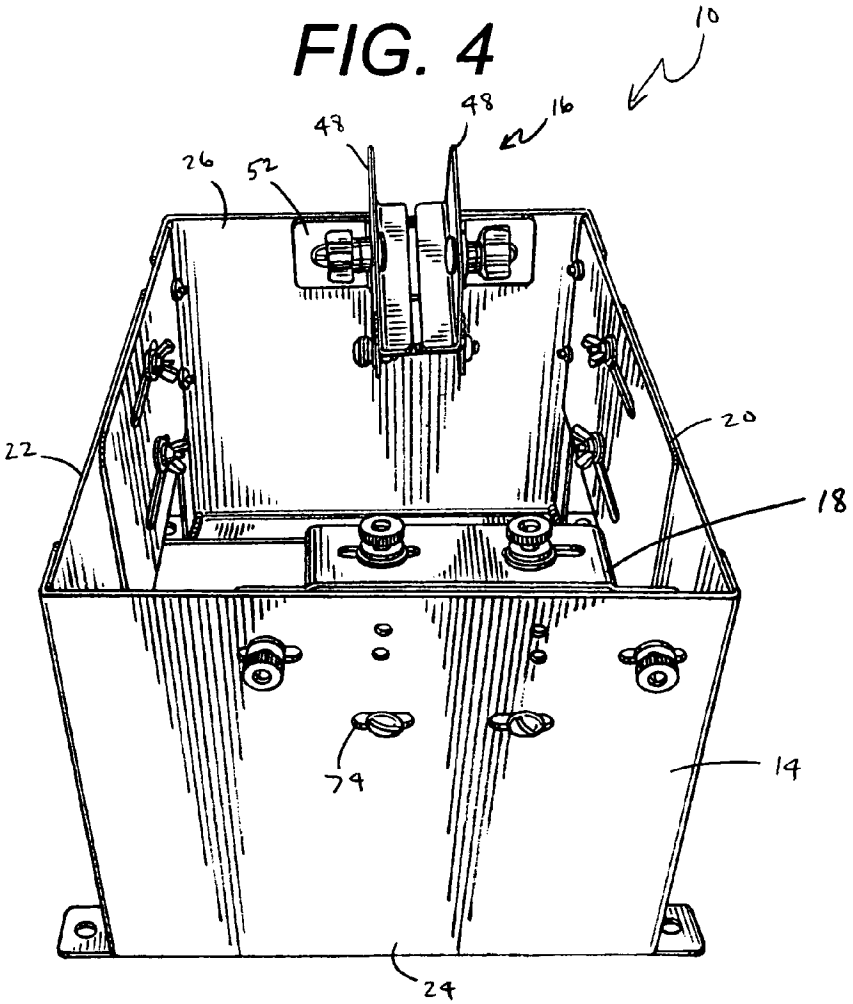
Figure 3:
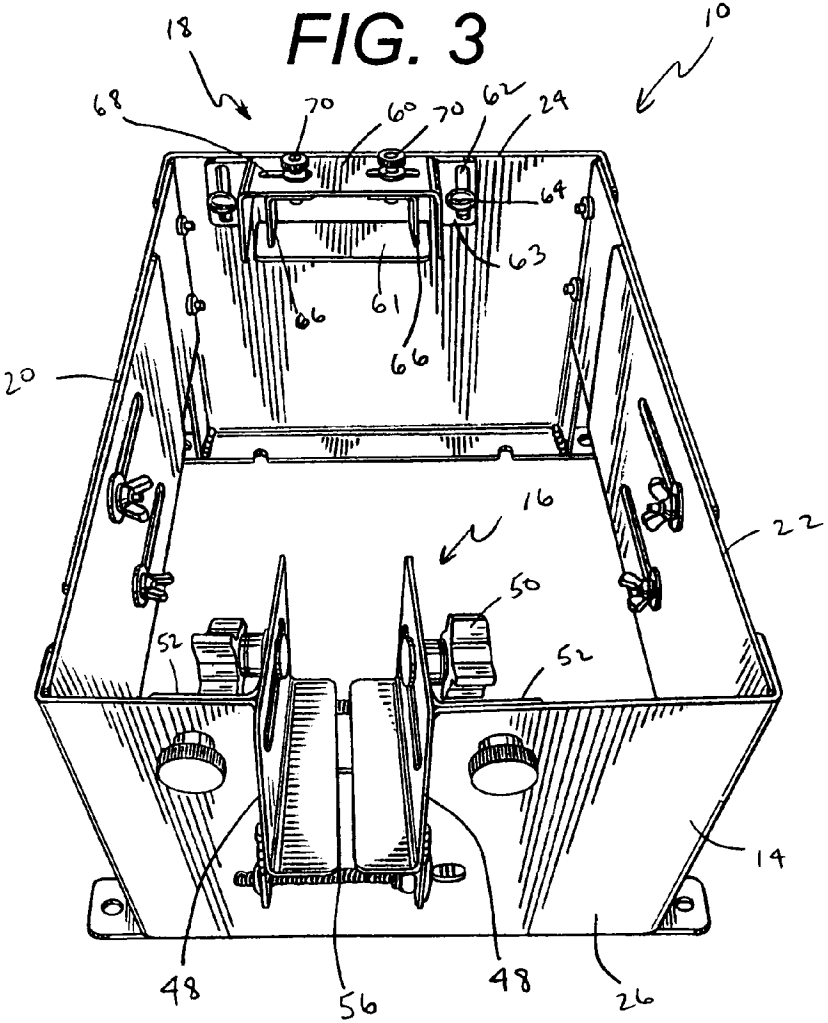
FIG. 3 is an end perspective view of the universal fixture of FIG. 2; and, FIG. 4 is an opposing end perspective view of the universal fixture of FIG. 2.

Although housing 14 is described as comprising one or more sidewalls, the height of each sidewall 20, 22, 24, 26 in relation to the overall height of the housing 14 may vary. Each sidewall 20, 22, 24, 26 need not extend along the entire height of the apparatus. Indeed, as shown in FIGS. 1 and 2, first sidewall 20 and second sidewall 22 do not extend down all the way to the base of the housing 14. However, as shown in FIGS. 3 and 4, third sidewall 24 and fourth sidewall 26 do extend from down to the base of the housing 14. One skilled in the art can fabricate the height of the sidewalls as desired. In addition, the universal fixture 10 may be constructed to have sidewalls that are adjustable in height relative to the surface upon which the fixture is placed.

Further, although not shown, housing 14 may optionally comprise a bottom wall or other bottom surface if desired, for example, to protect the power tool and/or to provide a larger mounting surface on which to mount universal fixture 10.

Referring again to FIG. 2, in one embodiment the first and second ends of the third sidewall 24 and the fourth sidewall 26 have transverse portions 27 extending therefrom. This allows for attachment of the third sidewall 24 to the first end 29 of the first and second sidewalls 20, 22, and for the fourth sidewall 26 to be attached to the second end 31 of the first and second sidewalls 20, 22, respectively. In a preferred embodiment the sidewalls are connected with fasteners 28, such as bolts and nuts to form the housing 14. This method of attachment is not required. It is understood that any type of fastener, screw, or other adhesive may be used to connect the adjacent sidewalls 20, 22, 24, 26 together to form the housing 14. Alternatively, one or more of the sidewalls 20, 22, 24, 26, or the entire housing 14, may be formed as a single piece. Whether it is more efficient to fabricate the housing 14 from one or more pieces may depend on factors such as the materials used.

In the embodiment shown in FIGS. 1 and 2, first sidewall 20 and second sidewall 22 are adjustable in length, preferably slidably. Accordingly, the first and second sidewalls 20, 22 can transition from a first length (in a short configuration) to a second length (in a larger configuration) to shorten and lengthen the cavity 29 of the housing 14. It is understood that the sidewalls 20, 22 can also attain any length between the shortened and lengthened configurations. In this embodiment this is accomplished because first sidewall 20 and second sidewall 22 are each formed by two members. Turning to second sidewall 22 in FIG. 2 as an example, second sidewall 22 comprises an inner wall portion 30 having slots 32 running along at least a portion of the length of second sidewall 22. Outer wall portion 34 has an aperture 35 to allow fasteners 36 to rigidly connect outer wall portion 34 to inner wall portion 30. Together, inner wall portion 30 and outer wall portion 34 collectively form second sidewall 22, which is adjustable in length by adjusting the point of attachment of fasteners 36 within slots 32 (i.e., the relationship between the inner wall portion 30 and the outer wall portion 34.) In this embodiment, two slots and fasteners are shown, however, more or less slots and fasteners may be used. Alternatively, sequential holes may be in the wall portions instead of slots, to adjust the length of the sidewalls in discrete increments. Alternatively, any other mechanism known to those skilled in the art may be used to form a sidewall having an adjustable length. For example, the second wall portion 34 may slide within the first wall portion 30. In addition, in like manner to which first sidewall 20 and second sidewall 22 are adjustable in length, any other of the sidewalls may also be adjustable in length.

Returning to FIG. 1, universal fixture 10 is shown with a portable power tool 12 mounted therein (in this example, a belt sander). At least a portion of power tool 12 is secured within the cavity 29 formed by housing 14. In this embodiment the first adjustable retainer 16 is attached to the first handle 38 of the power tool 12, and the second handle 40 of the power tool 12 is secured by the second adjustable retainer 18.

In the embodiment shown in FIG. 1, power tool 12 is mounted such that the sanding surface 42 of power tool 12 is generally parallel to the ground. As described below, embodiments of the present invention allow adjustment of the angle of the sanding surface 42 with respect to the ground, if a different working angle is desired during use.

FIGS. 1 and 2 show universal fixture 10 with optional mounting members 44. In one embodiment the mounting members 44 comprise legs 44 extending from one or more of the sidewalls 20, 22, 24, 26. Mounting members 44 may have apertures 46 by which a fastener or other mechanism (not shown) may substantially rigidly attach universal fixture 10 to a mounting surface, such as a floor, a workbench, or a wall. It may be desirable to rigidly attach universal fixture 10 to a surface in order to properly hold power tool 12 in place when, for example, greater precision is required, or when operation of power tool 12 distributes forces to universal fixture 10 that would cause the universal fixture 10 to undesirably move. It should be noted that although the attachment of universal fixture 10 to a mounting surface is described as "rigid," in practice some amount of vibration may occur, due to operation of the particular power tool being secured therein. In addition, mounting members 44 may allow attachment of universal fixture 10 to a mounting surface by means other than as shown or described herein. For example, mounting members 44 may be clamped, or adhesively attached, or attached by means of a friction fit to a mating member on the mounting surface (not shown). Alternatively, weights (not shown) may be placed on mounting members 44 to secure universal fixture 10 in place.

FIG. 3 shows an end perspective view of the universal fixture 10 of FIGS. 1 and 2. In the embodiment shown, the first adjustable retainer 16 is comprised of two retaining members 48. The first retainer 16 is adjustable in size and location with respect to the housing 14. In a preferred embodiment the retaining members 48 comprise generally L-shaped brackets, adjustably mated together to form an adjustable U-shaped channel member.

In one embodiment the first retainer 16 extends from the fourth sidewall 26. Referring back to FIG. 2, each retaining member 48 is operably connected to the fourth sidewall 26 of the housing 14 by an adjustable mounting bracket 52 and fastener 54, and is adapted to secure a first handle of a portable power tool. Alternative methods known to one skilled in the art may be employed to affix the first adjustable retainer 16 to a sidewall, such as clips, adhesives, or the like. Alternatively, the first adjustable retainer 16 may be formed or molded from the same material as fourth sidewall 26. The mounting bracket 52 has a slot therein to allow the bracket 52 to be adjustable up and down with respect to the sidewall 26 for further adjustability of the retainer 16.

As best shown in FIG. 3, the interior width of the first adjustable retainer 16 may be changed to accommodate portable power tools of differing sizes. The space between retaining portions 48, and hence the interior width of first adjustable retainer 16, may be changed with the use of adjustment screws 56 connecting each of the retaining portions 48. Further each retaining portion 48 has a slot 58 (shown in FIG. 2) extending the length of the retaining members 48. When the knobs 50 connecting the retaining portions 48 to the mounting brackets 52 are sufficiently loosened, retaining portions 48 may slide both angularly and lengthwise about a longitudinal axis of the housing 14, allowing retaining portions 48 to optimally secure handles of different size and shape power tools. Thus, adjustment screws 56, in conjunction with adjustment knobs 50, allow first adjustable retainer 16 to accommodate power tool handles of different sizes.

First adjustable retainer 16 also has retaining knobs 50. When a handle of the portable power tool is placed in first adjustable retainer 16, as shown in FIG. 1, knobs 50 are tightened, which allows at least a some of the length of each retaining portion 48 to contact the power tool handle and thereby fixedly retain the handle in universal fixture 10.

Depending upon the shape and length of the slots 58 in the retaining members 48, the first adjustable retainer 16 may be angularly adjustable, so that the plane formed by the length of retaining portions 48 pivots with respect to fourth sidewall 26. This may be desirable to accommodate different power tool handle shapes. In addition, this angular adjustability may be further desirable to change the angle in which the power tool is placed in the housing 14. Thus, in FIG. 1, the angle between the plane of the belt sander surface and the plane upon which the fixture 10 is placed may be altered. Accordingly, the first adjustable retainer 16 is moveable in a plurality of directions with respect to the forth sidewall 16, i.e., a first angular direction and a second longitudinal direction. The angular position is adjustable about a pivot point of the knob 50.

As shown in FIGS. 2 and 3, the second adjustable retainer 18 may also be adjustable to accommodate portable power tools of differing sizes and different handle configurations. The second adjustable retainer 18 is adjustable both in position and size. The second adjustable retainer 18 is adjustable in a first direction (up and down) with respect to the third sidewall 24, as well as in a second direction (left and right) with respect to the third sidewall 24.

The second adjustable retainer 18 comprises a first mounting bracket 60, a second mounting bracket 61, and interior retaining flanges 66. The first mounting bracket 60 has wings 63 with vertical slots 62 to allow the first mounting bracket 60 of the second adjustable retainer 18 to be repositioned up and down by readjusting the fasteners 64 therein. Additionally, horizontal slots 74 in the third sidewall 24 of the housing 14 allow the fasteners 64 and first mounting bracket 60 to be repositioned left and right with respect to the third sidewall 24. This method of assembly allows second adjustable retainer 18 to be adjusted in height relative to the surface upon which universal fixture 10 is placed, to accommodate different size power tools, as well as lateral position. Moreover, by adjusting the height of second adjustable retainer 18, while keeping the configuration of first adjustable retainer 16 fixed, allows an operator to adjust the angle with which the power tool is mounted within the cavity formed by housing 14.

The second mounting bracket 61 of the second retainer 18 operates as a shelf or bottom for retaining the second handle of the power tool 12. In a preferred embodiment the second mounting bracket 61 comprises an angle bracket that is horizontally and vertically adjustable via slots 74 in the third sidewall 24, and slots in the second mounting bracket 61.

The retaining flanges 66 are affixed to the first mounting bracket 61 via fasteners 70. In the embodiment shown, retaining flanges 66 may be simple angle brackets. Retaining flanges 66 are moveable by repositioning the fasteners 70 in the slots 68 in the first mounting bracket 61. Retaining flanges 66 may also be rotated about the axis of the fasteners 70, by loosening the appropriate fastener 70, rotating the retaining flange 66 into the desired position, and then tightening fastener 70. This allows the retaining flanges to clamp to a power tool handle at a different angle, to securely accommodate different size power tools. Moreover, the horizontal position of flanges 66 may be altered by loosening fasteners 70 and moving retaining flanges 66 within slot 68, until the desired position is reached, and then tightening fasteners 70. Accordingly, a perimeter of the second retainer 18 is adjustable to decrease in size for securing the handle of a power tool.

Turning to FIG. 4, the reverse side of second adjustable retainer 18 is shown mounted to third sidewall 24. As explained herein, the third sidewall 24 contains slots 74 allowing second adjustable retainer 18 to be movable in the horizontal direction along third sidewall 24. In FIG. 3, slots 62 are shown in the mounting brackets 60, allowing movement in the vertical direction. These two adjustments allow the retainer 18 to be adjusted in two directions or axes in a plane generally parallel to a plane of the sidewall.

The length and orientation of slots can be varied to suit the needs of one skilled in the art, to accommodate portable power tools of differing sizes. In addition, alternatives to a slot-and-fastener mechanism to attach the adjustable retainers to the sidewalls may be used. For example, in place of slots, the sidewalls may contain alternate holes 76 (shown in FIG. 4), and the operator may use the appropriate holes to locate the adjustable retainers at the desired position on the sidewalls. Alternatively, clamps, adhesives, or like approaches may also be used to allow the adjustable retainers to be moveably affixed to the sidewalls. All methods of attachment known to those skilled in the art may be utilized as appropriate.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the term "having" as used herein in both the disclosure and claims, is utilized in an open-ended manner.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying Claims.

What is claimed is:

1. A universal fixture for securing a portable power tool, the universal fixture comprising:

a housing having first sidewall, a second sidewall opposing the first sidewall, a third sidewall adjacent the first sidewall and the second sidewall, and a fourth sidewall opposing the third sidewall and adjacent the first sidewall and the second sidewall, the first and second opposing sidewalls being adjustable in length to transition from a first length to a second length, the second length being greater than the first length, the first and second sidewalls each having a first end and a second end, wherein a distance between the first ends and the second ends increases when the sidewalls adjust from the first length to the second length, wherein a cavity is defined between the first, second, third and fourth sidewalls, and wherein the universal fixture is adapted to accept at least a portion of the portable power tool in the cavity;

a first adjustable retainer connected to one of the sidewalls and adapted to secure a first handle of the portable power tool, the first adjustable retainer being moveable in a first direction with respect to the sidewall connected thereto; and, a second adjustable retainer connected to one of the sidewalls and adapted to secure a second handle of the portable power tool, the second adjustable retainer being moveable in a first linear direction with respect to the sidewall connected thereto.

2. The universal fixture of claim 1, wherein the second adjustable retainer is moveable in a second linear direction with respect to the sidewall connected thereto.

3. The universal fixture of claim 1, further comprising legs extending from the sidewalls.

4. The universal fixture of claim 3, wherein the legs have mounting members for fixedly attaching the universal fixture to a mounting surface.

5. A universal fixture for securing a belt sander, the universal fixture comprising:

a housing having a plurality of sidewalls defining a cavity for accepting at least a portion of the belt sander, at least two of the sidewalls having a length adjustable from a first position to a second position to adjust the size of the cavity the at least two sidewalls each having a first end and a second end, and a distance between the first ends and the second ends increases when the sidewalls adjust from the first length to the second length; and, a plurality of retainers extending from the sidewalls for securing the belt sander, wherein at least one of the retainers is adjustable with respect to the sidewalls to secure belt sanders of varying sizes.

6. The universal fixture of claim 5, wherein sidewalls having the adjustable length have a slot therein and a mating fastener to adjust the length thereof.

7. The universal fixture of claim 5, wherein at least one of the retainers is angularly adjustable to adjust the angle of the retainer respecting a plane defined by the sidewall.

8. The universal fixture of claim 5, wherein at least one of the retainers secures a handle of the belt sander and has a plurality of walls adjustable in size for securing variable size handles.

9. The universal fixture of claim 5, wherein adjustable length sidewalls comprise two slidable members.

10. The universal fixture of claim 5, wherein the retainers are adjustable in a plane generally parallel to a plane of the sidewalls.

11. The universal fixture of claim 10, wherein the retainers are adjustable in two axes.

12. The universal fixture of claim 5, wherein one of the retainers comprises a channel member to receive a handle of the belt sander.

13. A universal fixture for securing a belt sander, the universal fixture comprising:

a housing having a plurality of sidewalls;

a first retainer extending from one of the sidewalls and having an open cavity for securing a first handle of the belt sander therein, the first retainer being adjustable in a plane generally parallel to of one of the sidewalls to secure belt sanders of varying sizes; and, a second retainer extending from one of the sidewalls and having an open cavity for securing a second handle of the belt sander therein, the second retainer being adjustable in a plurality of angles relative to a plane of one of the sidewalls, the second retainer also being linearly adjustable, and the second retainer having an open cavity for securing a second handle of the belt sander.

14. The universal fixture of claim 13, wherein the sidewalls define a cavity to accept at least a portion of the belt sander.

15. The universal fixture of claim 13, wherein the second retainer comprises a generally U-shaped channel.

16. The universal fixture of claim 13, wherein the fixture further comprises a mounting mechanism for mounting the universal fixture to a mounting surface.

17. The universal fixture of claim 13, wherein a perimeter of one of the retainer cavities is adjustable to decrease in size for securing the handle of the belt sander.

18. The universal fixture of claim 13, wherein one of the retainers is linearly moveable side-to-side perpendicular to a longitudinal axis of the fixture.

19. The universal fixture of claim 13, wherein a bottom of the housing is open.

* * * * *